US006547118B2

(12) United States Patent
Beletsky et al.

(10) Patent No.: US 6,547,118 B2
(45) Date of Patent: Apr. 15, 2003

(54) TACTICAL RIG FOR LAW ENFORCEMENT AND MILITARY USE, INCLUDING HOLSTER

(75) Inventors: Robert J. Beletsky, Fallbrook, CA (US); Carl R. Eerdmans, Fallbrook, CA (US); Roy P. Huntington, Temecula, CA (US); Werner Sommer, Murrieta, CA (US)

(73) Assignee: Bianchi International, Temecula, CA (US)

( * ) Notice: Subject to any disclaimer, the term of this patent is extended or adjusted under 35 U.S.C. 154(b) by 0 days.

(21) Appl. No.: 09/792,678

(22) Filed: Feb. 24, 2001

(65) Prior Publication Data

US 2003/0029897 A1 Feb. 13, 2003

(51) Int. Cl.[7] ..... F41C 33/02

(52) U.S. Cl. ..... 224/661; 224/677; 224/680; 224/684

(58) Field of Search ..... 224/911, 661, 224/666, 238, 677, 669, 680, 684

(56) References Cited

U.S. PATENT DOCUMENTS

| | | | | | |
|---|---|---|---|---|---|
| 4,022,361 | A | * | 5/1977 | Devlin | 224/192 |
| 4,103,807 | A | * | 8/1978 | Lyon et al. | 124/23.1 |
| 4,627,558 | A | | 12/1986 | Bianchi et al. | |
| 4,690,315 | A | | 9/1987 | Bianchi | |
| 4,750,656 | A | | 6/1988 | Bianchi et al. | |
| 4,815,641 | A | * | 3/1989 | Bianchi et al. | 224/192 |
| 4,828,154 | A | * | 5/1989 | Clifton, Jr. | 224/192 |
| 4,848,624 | A | * | 7/1989 | Clem | 224/222 |
| 4,953,767 | A | * | 9/1990 | Bennett | 224/192 |
| 4,966,321 | A | * | 10/1990 | Outlaw | 224/674 |
| 5,215,238 | A | * | 6/1993 | Baruch | 224/243 |
| 5,388,740 | A | * | 2/1995 | Garland | 224/242 |
| 5,445,303 | A | * | 8/1995 | Cawile, Jr. | 224/222 |
| 5,875,944 | A | * | 3/1999 | Beletsky | 224/198 |
| 5,991,925 | A | * | 11/1999 | Wu | 2/102 |
| 6,149,042 | A | * | 11/2000 | Rassias | 224/243 |
| 6,264,079 | B1 | * | 6/2001 | Chen | 257/109 |

OTHER PUBLICATIONS

Safariland Catalog, Issue 35, 1998, pp. 8 and 9.
Blackhawk Catalog, Undated, pp. 13, 16?, 23, 25, 27, and 29.
Shooting Systems 20 Year Catalog, 1999, pp. 20 and 43.

* cited by examiner

*Primary Examiner*—Stephen P. Garbe

(57) ABSTRACT

A tactical rig to be worn by police and military personnel includes an accessory panel which is strapped to the thigh of an individual and which is secured to the belt of the wearer with an adjustable strap. The accessory panel includes three heavy straps secured to itself including a series of stitchings which define loops for attaching pouches. One of the pouches may be a holster, which is secured to the panel with a fastener, such as a spring clip passing through one of the loops. The holster is generally U-shaped in cross-section and includes extended portions having loop and pile fasteners which combine to provide a double wrap around a handgun with an attached tactical light or other object carried in the holster. Because of the extended portions and the loop and pile fasteners, there is considerable flexibility in the size and shape of an object, which can be safely carried in the holster. Straps passing over the top of the holster with snap fasteners provide additional assurance that the handgun/light combination will be securely carried despite strenuous activity by the wearer.

17 Claims, 5 Drawing Sheets

FIG. 1
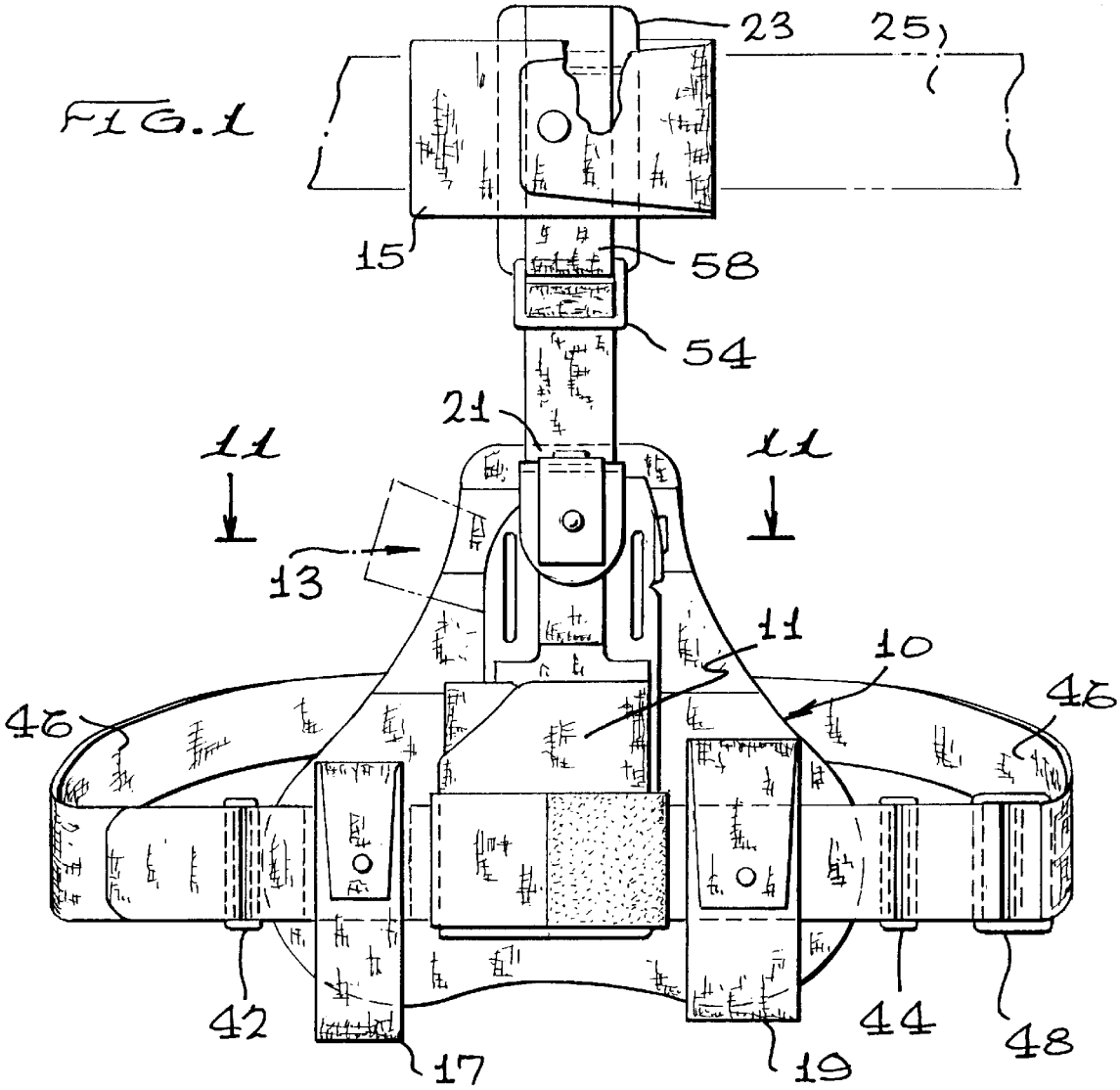
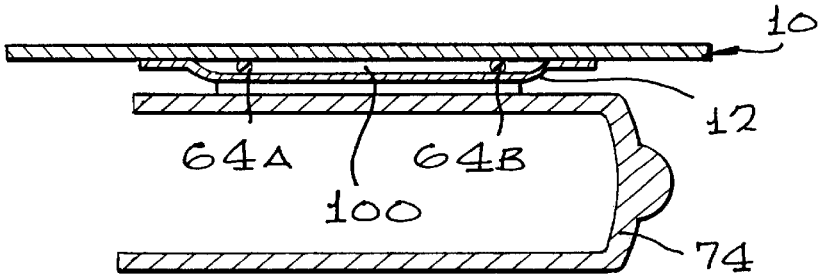
FIG. 11

TACTICAL RIG FOR LAW ENFORCEMENT AND MILITARY USE, INCLUDING HOLSTER

BACKGROUND OF THE INVENTION

In law enforcement and military operations, there is a need for a versatile suspension system for carrying a handgun in a holster along with any one or more of a variety of accessory pouches or tactical items. In the past, this has resulted in making compromises to attempt to match the specific tactical need. Often, the need may be only recognized as the tactical situation develops. For example, an officer may be called upon to employ either a handgun or a long gun, rifle or shotgun, and needs to have the appropriate magazine pouch for the weapon used or a pouch accommodating shotgun shells or a distraction or "bang" round. Sometimes the tactical situation requires the use of an agent, such as mace to temporarily disable an aggressor. Each of these separate types of projectiles or tactical items need their own special pouch to assure safe, precise and silent carrying of their contents and most important, immediate access when the need arises.

Likewise, the tactical situation may require that different handguns may be needed and that each of the special rounds for each weapon must be conveniently located for the user and rapidly interchanged. It is not desirable to carry a number of different holsters and to have to attach them to a belt or other carrier during a tactical maneuver. Therefore, a holster that fits a handgun with a variety of lights is needed.

The assignee of this patent has produced a number of universal handgun holsters which have a broad versatility. Examples are illustrated in U.S. Pat. No. 4,627,558 and its related U.S. Pat. Nos. 4,690,315, 4,815,641, and 4,750,656. Typically, universal-type holsters require some adjustment or modification prior to use. Any such adjustments or modifications under imminent tactical situations are desired in many situations. Therefore, there is a need for a holster which will receive and hold a variety of handguns without modification but with equal security in expected tactical situations.

Since tactical situations often require the officer to wear hard body armor, the use of the officer's belt for the mounting of the holster and separate accessory pouches, is limited because such arrangement, which is common for duty officers, is restrictive of movement and may interfere with the proper utilization of the body armor. This indicates a need for a separate panel which can carry a holster along with a number of accessory pouches.

The user may need to carry his standard handgun with a lighting device which changes the size and shape of the holster to be carried. It should also be practical to remove and replace the holster and the handgun without delay and without change of the panel. Therefore, a need exists for a tactical rig, which can support a weapon of a particular size with an attached light along with other accessories all suspended from one point on a duty belt or web belt. Such a rig is preferably secured to the wearer's thigh providing a secure three-point support with no interference with the other gear on the duty belt.

BRIEF DESCRIPTION OF THE INVENTION

Faced with the above state of the art, we proceeded to develop a tactical rig, which allows flexibility in customizing a rig for each of a large number of missions and to do so in a matter of a few minutes or, in some cases, seconds.

The rig is intended to allow the wearer, whether he be police, military or even a sportsman, to attach or replace a variety of pouches or accessories to a unitary thigh-mounted panel with a universally adjustable wrap-around thigh strap and with a single adjustable length belt suspension attachment. There are virtually hundreds of different accessories or pouch combinations possible, which may be attached to the panel, some mounted vertically and others mounted horizontally on the panel.

The panel is configured in a generally triangular shape with rounded apexes to lie on either of the wearer's thighs. A handgun, securely carried in a holster, is readily available and the holster is securely attached to the panel. The holster and any one of the pouches or accessories which the wearer has selected to be worn are within easy grasp. The wearer may unholster the handgun and have the contents of any of the pouches ready for unloading of their contents for immediate use. This tactical rig and holster illustrated are ambidextrous for added flexibility. Right or left handed-only holsters may, of course, be used with the tactical rig of this invention.

A universal holster, which is designed to receive a handgun, in combination with variety of tactical lights or other accessory, is firmly secured preferably to a central position on the panel in a manner which prevents the holster from flopping up and down during active movements. The central position of the holster places it over the hard surface of the wearer's thighbone ready for opening the holster and grasping and drawing of the handgun. The panel includes a non-skid under surface which adds to the positive positioning of the handgun and holster for the user. Despite the presence of several pouches or accessories, each securely attached to the panel, the grip of the handgun is exposed. A folded, double latch strap on the holster is immediately accessible for release and easy draw of the handgun.

The particular holsters of the present invention are adaptable to be used with the most commonly tactically used handguns, with tactical lights attached on the barrel or frame, by reason of a double-wrap hook and pile secured wrap-around closure.

The panel is preferred to be in a generally triangular shape with rounded corners, of a semi-rigid, flexible, foam laminate stiffener covered on its underside by a non-skid mesh to prevent slipping on the wearer's trouser leg. One apex of the generally triangular panel is worn directed upward toward the wearer's belt, and the other two apexes are wrapped around a leg and secured by straps having either hook and pile or other fastener means. The upper apex includes an adjustable length strap and a belt loop or belt fastener so that the rig may be worn at any desired height between the waist and the wearer's knee. The central region of the outer surface of the panel member is normally reserved for holster attachment and the remaining areas are available for mounting accessories or pouches.

A series of sturdy web straps are stitched to the panel to define a number of attachment points for accessories or pouches. These may be attached to the panel at the web straps employing suitable attachments such as the proven universal clip of U.S. Pat. No. 4,690,315.

In summary, the panel is the foundation and basic building block for a universal tactical rig, and the holster of this invention is the keystone.

BRIEF DESCRIPTION OF THE DRAWING

This invention may be more clearly understood from the following detailed description of the invention and by reference to the drawing, in which:

FIG. 1 is a front elevational view of the preferred embodiment of this invention including a belt shown in phantom and the accessory panel carrying a holster of this invention and selection of three pouches attached to the rig with one horizontal on the belt attachment and two attached vertically to the panel member and generally surrounding the holster;

FIG. 11 is a fragmentary sectional view of the panel and holster taken along line 11—11 of FIG. 1.

DESCRIPTION OF THE PREFERRED EMBODIMENT

Figure 2:
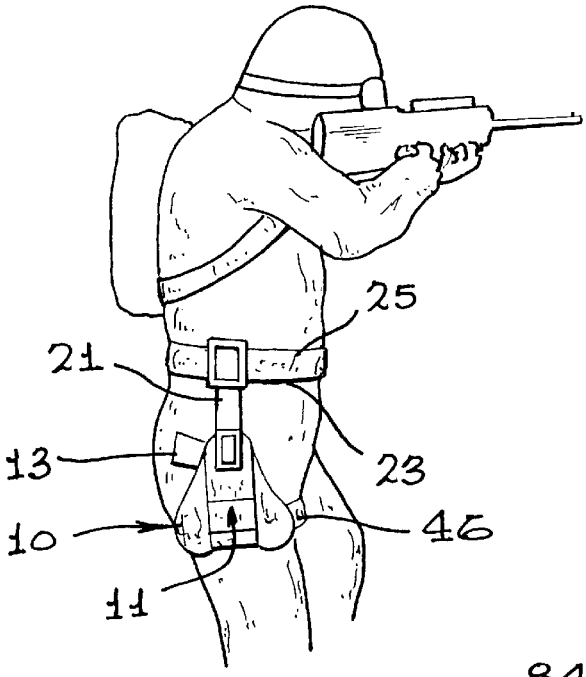
FIG. 2 is a perspective view of the tactical rig of FIG. 1 shown as typically worn by a law enforcement officer in tactical garb.

FIG. 1 is a front elevational view of a tactical rig according to this invention. Mounted on a generally triangular accessory panel 10 is a holster 11 enclosing a handgun 13 shown in dashed lines. Also mounted on the rig are three accessory pouches 15, 17, and 19. A strap 46 is secured at one side of panel 10 and extends around the back side of panel 10 for strapping the panel to the thigh of a wearer. An adjustable strap 21 (best shown in FIG. 4) permits a small belt attachment panel 23, which carries a belt clip described below and shown in FIGS. 5 and 5A, to be moved up or down on adjustable strap 21 to provide the desired vertical position of panel 10 on the wearer's thigh relative to the belt 25.

The tactical rig of this invention is shown in FIG. 2 as it would be worn by a police officer or military personnel or possibly by sportsmen. The panel 10 is shown secured to the thigh of an individual by means of strap 46, which wraps around the wearer's thigh and allows lateral positioning on either thigh. The strap 21 is extended to permit panel 23 to be secured to belt 25. Holster 11, carrying handgun 13, is shown secured to panel 10. Other accessory pouches, such as pouches 15, 17 and/or 19 of FIG. 1 may be used to carry extra magazines for handgun 13 or for other accessories, such as mace or handcuffs, etc.

Figure 3:
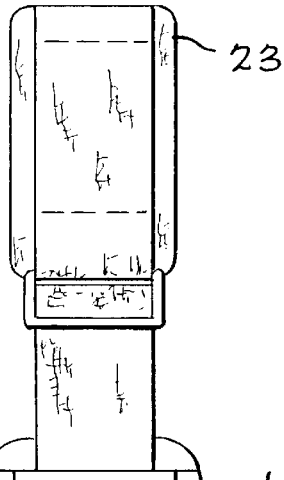
FIG. 3 is a front elevational view of the accessory panel member of this invention.

FIG. 3 is a front elevational view of the generally triangular modular accessory panel 10 forming part of the present invention. This panel 10 includes a facing of durable material, such as ballistic nylon secured to an internal stiffening member, which causes the panel 10 to retain its shape, but which permits the panel to be wrapped over and part way around a wearer's thigh. Secured to the facing are a plurality of transverse extending straps 12, 14 and 16 of heavy nylon. Strap 12 has fastened thereto a loop 18 of similar material stitched across the center which receives a clip metal locking device, discussed below, which may be carried on any of the several pouches 15, 17 and 19. Strap 14 is stitched to panel 10 at its ends and at vertical seams 20 and 22, which are spaced to receive the clip or metal locking device which secures a holster or other pouch to panel 10.

A third strap 16 extends across the width of panel 10 and is double stitched at vertical seams 24 and 26 near the edges of panel 10 and at other vertical seams to capture plastic or metal ring members 30 and 32 which support an auxiliary strap 34 used to tie down the muzzle end of the holster. Sewn loops are formed at each end of strap 16 carrying rectangular rings 42 and 44. Passing over ring 44 is a short length of strap 46 which passes twice through a double-loop slider 48, one end of strap 46 being secured to itself between ring 44 and slider 48 (FIG. 1). Strap 46 includes pile fastener material on one side and a length of loop fastener material at its other end, which is passed through ring 42 (FIG. 1) and folded back onto the pile material to provide an adjustable strap for securing panel 10 around the thigh of a wearer.

Figure 4:
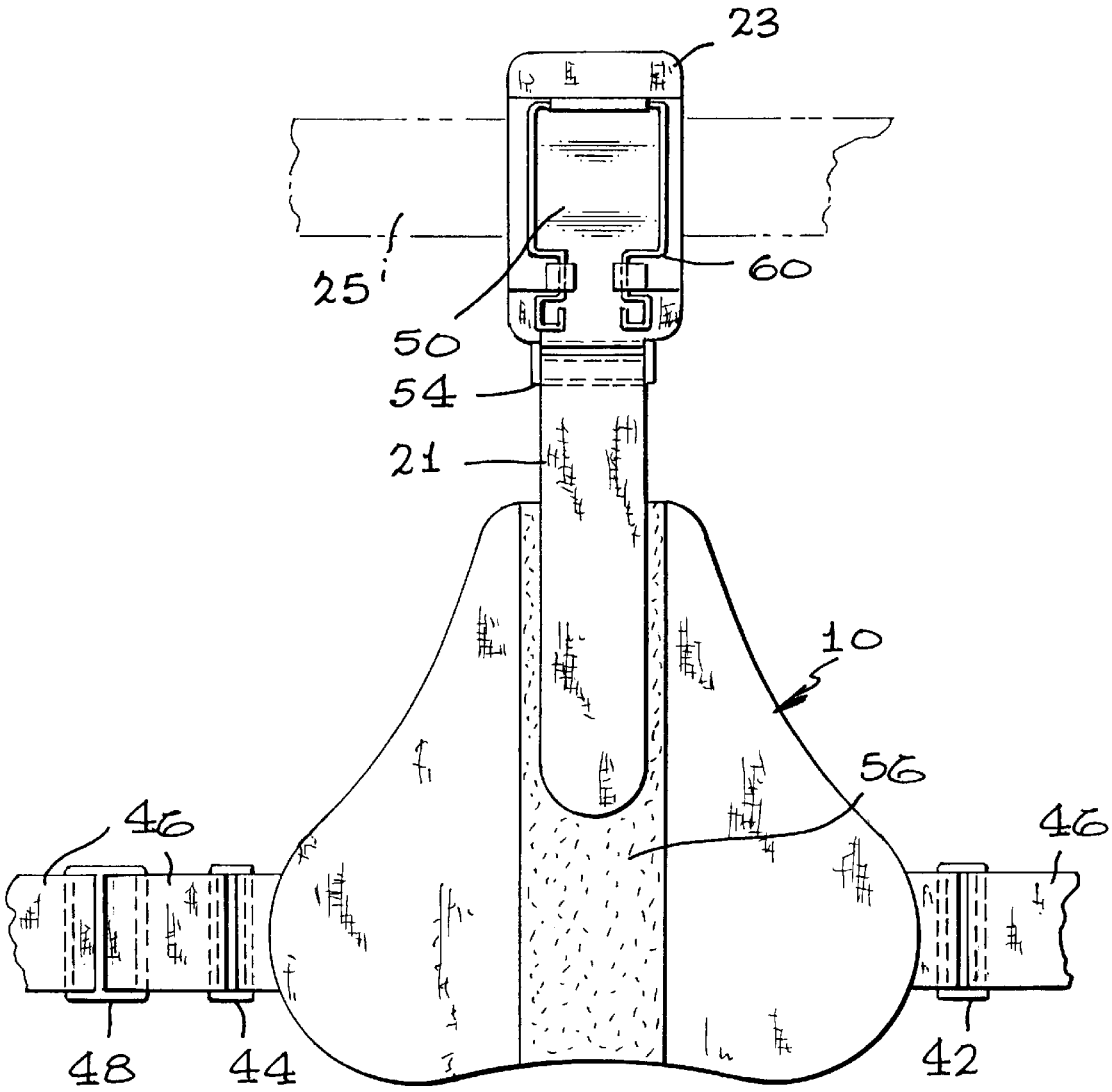
FIG. 4 is a rear elevational view of the panel of FIG. 1

FIG. 4 is a rear elevational view of the panel 10. This view shows rings 42 and 44 with strap 46 secured to ring 44 and passing through double-loop slider 48. The opposite end of strap 46, shown broken away in this view, is passed through ring 42 and folded back on itself so that strap 46 may be secured at any position along its length of pile fastener material. See FIG. 1.

Secured at the top front of panel 10 is a strap 21, which includes a length of fastener hook material and which is fed through a slider 54 and then directed down the back side of panel 10 where it is secured to a strip of fastener pile material 56 attached vertically to the center of panel 10. Also connected to slider 54 is a strap 58 secured to small panel 23, which has secured to its back side a metal clip or locking device 60 to be secured to the wearer's belt 25. To move panel 10 toward or away from panel 23, strap 21 is separated from pile material 56 permitting strap 21 to be moved through double loop fastener 54 to locate panel 23 as desired, after which strap 21 is again secured to pile strip 56.

Figure 5:
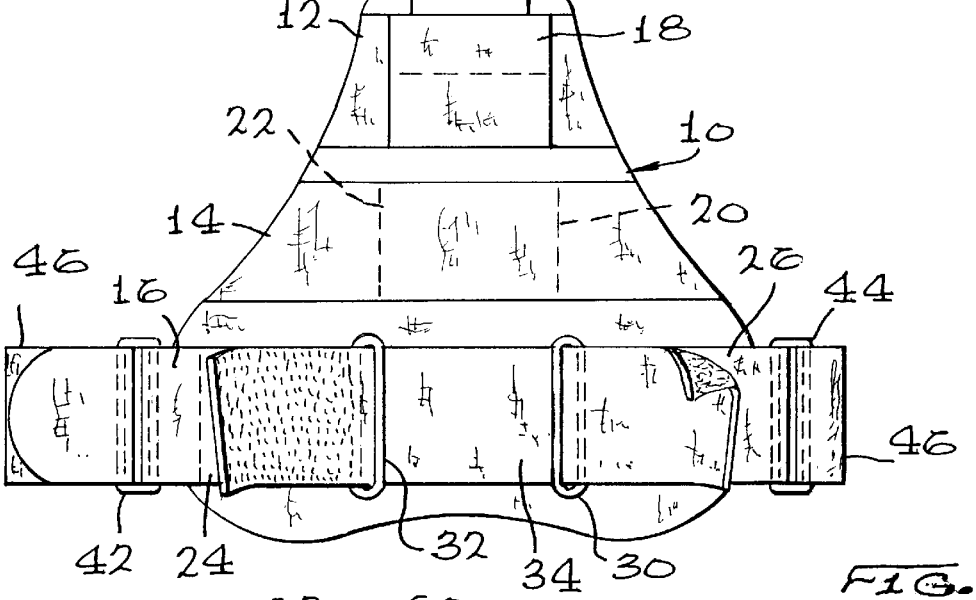
FIG. 5 is a front elevational view of the preferred fastener for use in carrying out this invention.
Figure 5A:
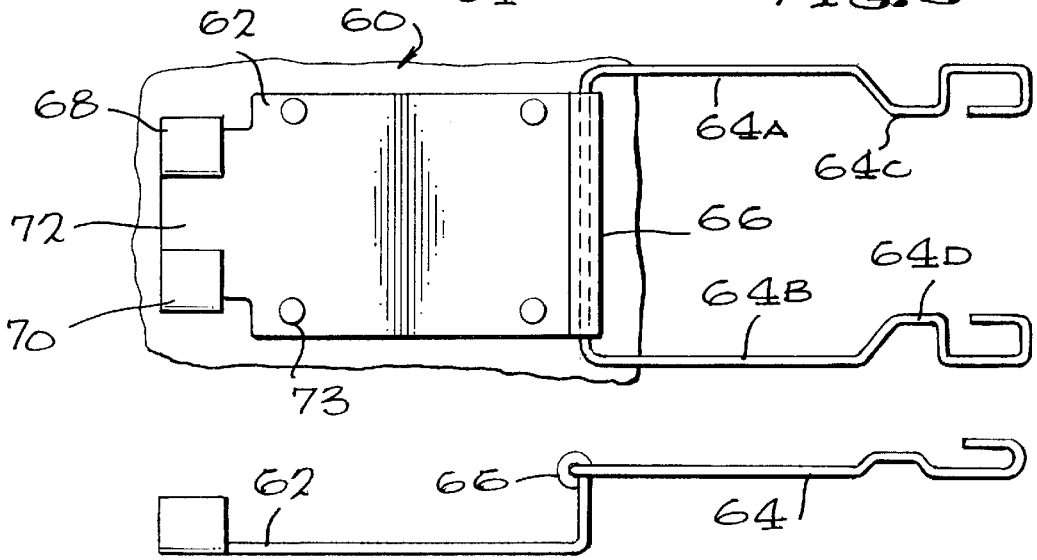
FIG. 5A is a side view of the fastener of FIG. 5.

The metal locking device or clip assembly 60 is shown installed on small panel 23 on FIG. 4 and as it appears before installation on FIGS. 5 and 5A. Small panel 23 is secured to belt 25 by the clip assembly 60, which includes a body portion 62 and a wire form member 64. Body 62 includes an integral hinge 66 formed into a roll and holding as a hinge pin, the central portion of the wire form member 64, which also has a pair of legs 64A and 64B. The body 62 also includes a pair of rolled catches 68 and 70, each of which engage the respective knee portions 64C and 64D of legs 64A and 64B, respectively. The clip assembly is the subject of U.S. Pat. No. 4,690,315.

The inherent spring properties of the wire form 64, which is preferably made of spring steel, hold the knees 64C and 64D in place between catches 68 and 70 after the two legs 64A and 64B are squeezed together and passed through an opening 72 between the catches 68 and 70. A plurality of holes 73 are shown in body 62, as may be seen in FIG. 5, which are useful in applying the clip to holding other types of devices, such as a canteen or one of the above-described pouches. As shown in FIG. 4, the body 62 of device 60 is secured behind a sturdy, flat, plastic member 50 attached to small panel 23. Other belt loop attachments may be used. The spring clip of FIGS. 4, 5 and 7 is of particular utility in this invention, since it allows rapid exchange of holsters if desired.

Figure 6:
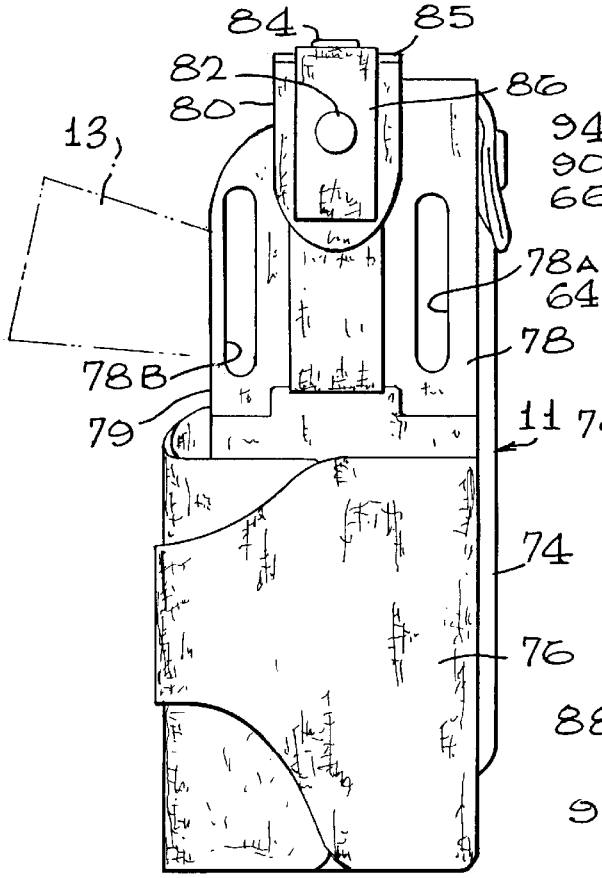
FIG. 6 is a front elevational view of the holster of this invention.
Figure 8:
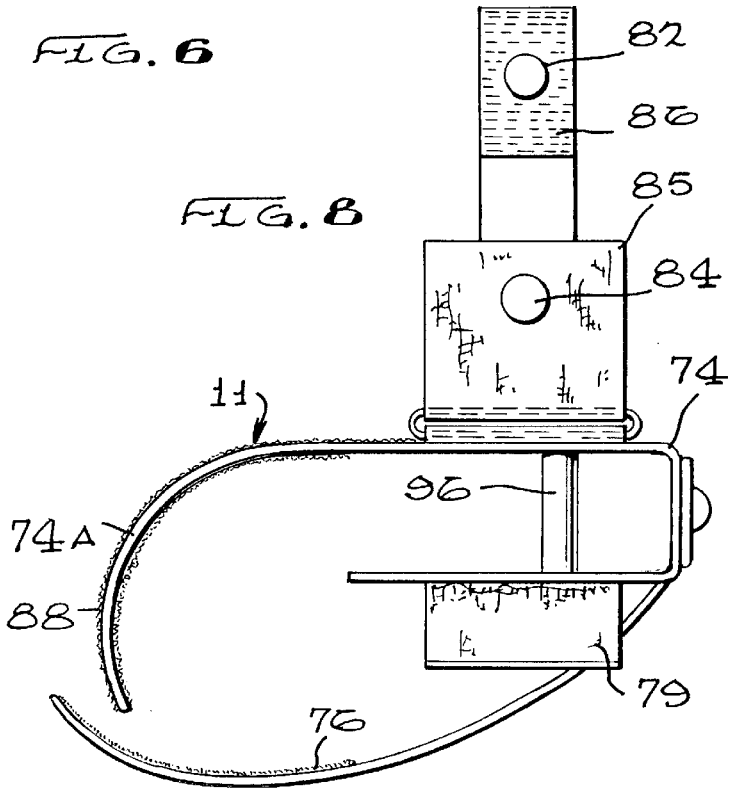
FIG. 8 is a top plan view of the holster of FIG. 7 with the top straps and fasteners open.

FIG. 6 is a front elevational view of the holster 11, which includes a main body 74, and a pair of wrap-around flaps 76 and 74A. Outer flap 76 has, on its reverse side, a section of fastener loop material, which is secured to a fastener pile strip 88 secured to the second flap 74A on the rear side of the holster 11 (FIG. 8). This arrangement permits considerable flexibility as to the size of handgun and handgun mounted tactical light which can be carried in holster 11.

Secured to the front of holster 11 of FIGS. 6–9 is a stiffener member 78 of molded plastic, including a pair of slots 78A and 78B, through which a belt may be inserted if the holster is not used as part of the presently described tactical rig. Also secured to member 78 is a strap 79 and a strap 80 secured thereto carrying a surface of fastener pile material and male parts of two snap fasteners 82 and 84. These male parts cooperate with female parts carried on straps 85 and 86, which extend across the top of holster 11 to secure the handgun 13 in the holster. Snap fastener 82 provides extra security to retain handgun 13 in active situations, such as rappelling, climbing over walls or running. The pile and loop fastening material is provided for reholstering quickly and providing a measure of security. The top snap fastener 84 replaces the typical thumb break but lies across the top of the holster.

Figure 7:
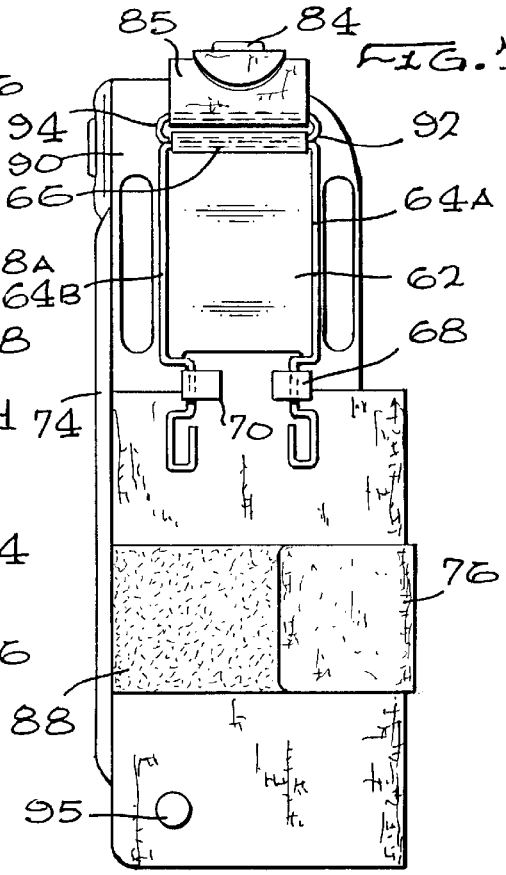
FIG. 7 is a rear elevational view of the holster of FIG. 6.

FIG. 7 is a rear elevational view of holster 11 and shows flap 76 wrapped around the body 74 of holster 11 and secured to a fastener pile strip 88 on body 74. A strong reinforcing member 90, similar to member 78, is secured to body 74 and includes a pair of slots 92, one of which appears in FIG. 7, which receives the body 62 of a clip assembly 60 which is carried between member 90 and body 74. Legs 64A and 64B, carried on body 62, are shown secured in catches 68 and 70. An additional loop fastener 94 secures strap 85, which passes over the top of holster body 74. Also shown on FIG. 7 is a screw 95 which supports a handgun barrel stop 96 described below.

FIG. 8 is a top plan view of the holster 11 of FIGS. 6 and 7 with the flaps 85 and 86 and outer wrap-around flap 76 open. In this view, it will be seen that flap 76, which has fastener loop material on its inside, is somewhat longer than flap 74A of body 74 so that flap 76 can wrap around flap 74A and be secured to the fastener pile strip 88. Since fastener pile strip 88 extends for the entire length of flap 74A, including body 74, there is appreciable expansion capability of holster 11 to contain various types of handguns with tactical lights. Secured to the inside of body 74 near its lower end is a handgun barrel stop 96.

Figure 9:
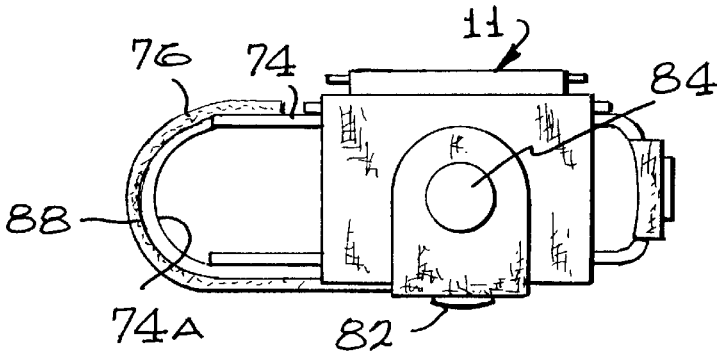
FIG. 9 is a top plan view of the holster of FIGS. 6, 7, and 8 in closed position.

FIG. 9 is a top plan view of the holster 11 with flap 76 wrapped around body 74 and flap 74A. As will be seen from FIG. 8, body 74 is basically U-shaped in cross section with the shorter extended flap 74A carrying pile fastener strip 88 and the longer flap 76 carrying loop fastener material. Straps 85 and 86 are shown with the snap fasteners 82 and 84 closed.

Figure 10:
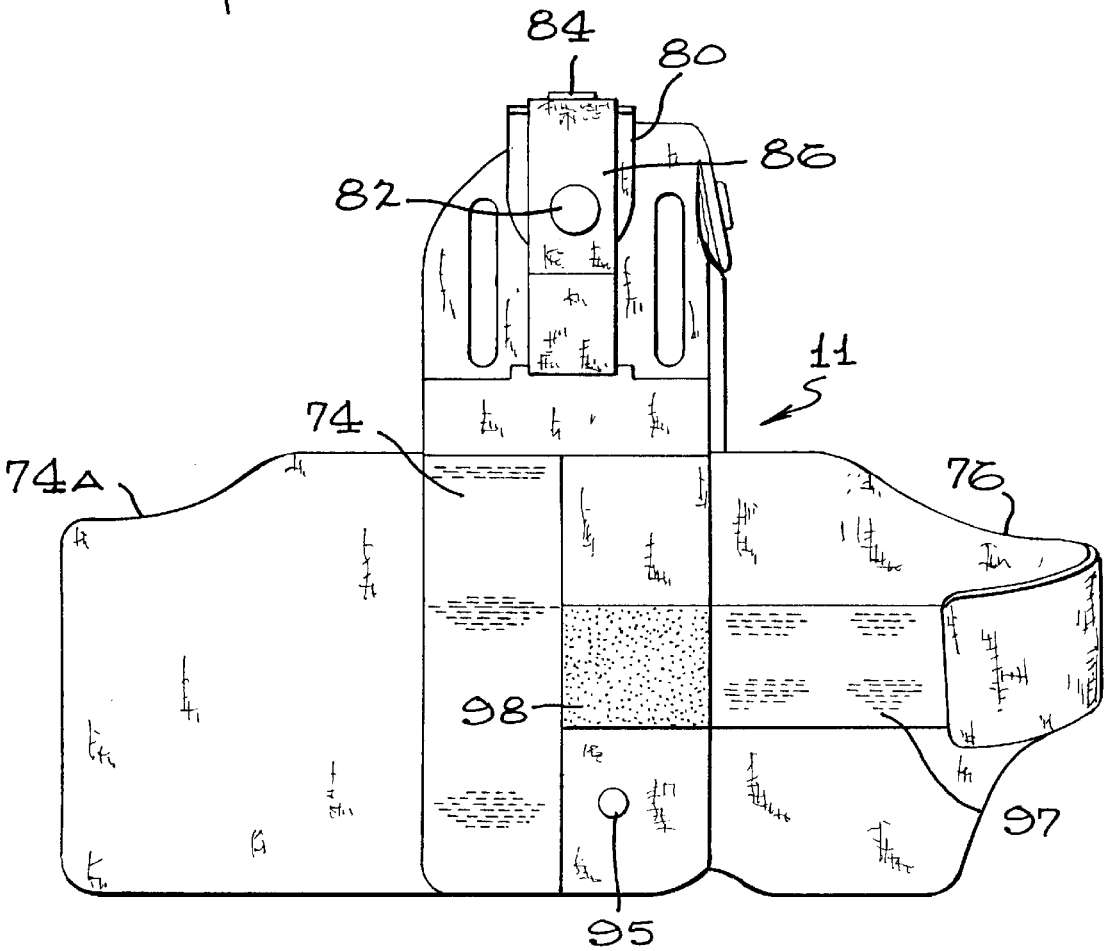
FIG. 10 is a front elevational view of the holster of FIGS. 6–9 with the two overlapping body portions opened as in the step of adjusting the holster size.

FIG. 10 is a side elevational view of the holster 11 with the body 74 open and the two overlapping flaps 74A and 76 extended. The inside of flap 76 includes a strip of fastener loop material 97 which extends its entire length and which fastens on a length of fastener pile material 98 on body 74 as well as on fastener pile material 88. When a handgun is placed in the body 74, flap 74A is wrapped closely around it and then flap 76 is wrapped around flap 76 thereby providing a double wrap to secure the handgun in place.

FIG. 11 is a sectional view taken along line 11—11 of FIG. 1. This view shows the manner in which holster body 74 is secured to the panel 10. Strap 12 is stitched to panel 10 with vertical stitching leaving a space 100 between panel 10 and strap 12. Legs 64A and 64B are confined between strap 12 and panel 10 and are squeezed together and caused to be captured in catches 68 and 70 of clip assembly 60.

From the foregoing, it will be appreciated that the tactical rig described above secures the weapon in a holster which is flexible enough to safely carry handguns of various types but similar sizes with attached tactical lights, which carries auxiliary pouches conveniently and safely, and which permits the wearer to move through rugged terrain with little concern that all or part of the rig will become unfastened.

The above-described embodiments of the present invention are merely descriptive of its principles and are not to be considered limiting. The scope of the present invention instead shall be determined from the scope of the following claims including their equivalents.

We claim:

1. A tactical rig for law enforcement officers and the military to be worn by a wearer having a belt comprising:

a panel including a strap for securing said panel to the thigh of the wearer;

a pouch secured to said panel;

a belt loop device for securing said belt loop device to said belt; and an adjustable strap connected between said panel and said belt loop device for enabling said panel to be positioned where desired on the thigh of the wearer; and a plurality of straps secured to said panel and stitched at intervals to provide loops and fasteners for holding a variety of pouches at the thigh region.

2. A tactical rig as claimed in claim 1 wherein one of said pouches is a holster.

3. A tactical rig as claimed in claim 1 wherein said means for securing said belt loop device to said belt includes a fastener comprising a clip with a body, catches and a spring member hinged to said body having legs securable in said catches.

4. A tactical rig as claimed in claim 3 wherein one of said fasteners is an attachment clip secured to said holster and said attachment clip is secured to one of said plurality of straps at one of said loops.

5. A tactical rig as claimed in claim 1 wherein said panel includes a strip of fastening material on one side;

said adjustable strap includes fastener material, mating with the fastener material on said panel; and a double loop fastener is secured to said belt loop device such that said adjustable strap is passed through said double loop fastener and secured to the fastener material on said panel at a desired position to determine the spacing between said panel and said belt loop device.

6. A tactical rig as claimed in claim 2 wherein said holster includes a body having a generally U-shaped cross-section having two sides with an extended portion on one side, a strip of fastener material extending the length of the extended portion and a holster strap extending from the opposite side having mating fastener material thereon such that said holster strap can be wrapped around said extended portion and secured at many possible positions.

7. A tactical rig as claimed in claim 1 wherein said belt loop device comprises a small panel and a spring clip secured to said small panel for capturing said belt between said spring clip and said small panel.

8. A tactical rig to be worn by a wearer having a belt comprising:

an accessory panel having a plurality of straps secured thereto and stitched at intervals to form loops;

at least one pouch secured to one of said straps at one of said loops;

loop fasteners secured to said panel;

a separate strap secured at one end to one of said loop fasteners and engagable with another of said loop fasteners for securing said panel to a thigh of the wearer;

an additional strap attached at one end to said panel including means for adjusting the length of said additional strap, and an attachment device connected to said additional strap for connecting said panel to said belt.

9. A tactical rig as claimed in claim 8 wherein said panel has the general shape of a triangle generally rounded at the apexes, and said at least one pouch comprises a holster.

10. A tactical rig as claimed in claim 9 wherein an attachment clip is secured to said holster and said attachment clip is secured to one of said plurality of straps at one of said loops.

11. A tactical rig as claimed in claim 9 wherein said separate strap is located at a lower apex of said panel and said additional strap is located at the top apex of said panel.

12. A tactical rig as claimed in claim 8 wherein a strip of fastener material is secured to the back of said panel, and said additional strap includes fastener material mating with said strip of fastener material for adjusting the length of said additional strap.

13. A tactical rig as claimed in claim 11 wherein a double loop fastener is secured to said panel at the top apex of said panel and said additional strap is secured to said double loop fastener.

14. A tactical rig as claimed in claim 8 wherein a double loop fastener is secured to said separate strap for adjusting the length of said separate strap.

15. A tactical rig for law enforcement and military use to be worn by a wearer having a belt comprising:

an accessory panel having front and back sides;

a plurality of straps secured to the front side of said panel and stitched thereto at intervals to form loops of predetermined sizes;

additional strap means attached to said panel for securing said panel to a thigh of the wearer;

a strip of fastener pile material attached vertically to one side of said panel, an additional strap attached at one end to said panel and adjustment means including fastener loop material engagable with said fastener pile strip for adjusting the length of said additional strap;

an attachment device for attaching said strap to said belt;

a holster for carrying a handgun including a body and an attachment clip for securing said holster to one of said loops;

an extended portion extending from a first part of said body and a strip of fastener pile material secured to said extended portion;

a holster strap extending from the opposite side of said body having fastener loop material engagable with said extended portion to form a double wrap around a handgun to be carried on said holster; and additional strap means extending across the top of said holster for securing said handgun in said pouch.

16. A tactical rig as claimed in claim 15 further comprising at least one pouch secured to another of said loops.

17. A tactical rig as claimed in claim 8 wherein said panel is semi-rigid and bendable to generally conform to the thigh of the wearer.

* * * * *